United States Patent [19]

Maurer et al.

[11] Patent Number: 4,546,685

[45] Date of Patent: Oct. 15, 1985

[54] DEVICE FOR SETTING THE THICKNESS OF CUT IN COLD MEAT SLICING MACHINES

[75] Inventors: Albrecht Maurer, Balingen; Alois Butz; Klaus Koch, both of Geislingen, all of Fed. Rep. of Germany

[73] Assignee: Bizerba-Werke Wilhelm Kraut GmbH & Co. KG, Balingen, Fed. Rep. of Germany

[21] Appl. No.: 574,663

[22] Filed: Jan. 27, 1984

[30] Foreign Application Priority Data

Feb. 10, 1983 [DE] Fed. Rep. of Germany ..... 3304610

[51] Int. Cl.[4] ..... B26D 7/06; B26D 7/26

[52] U.S. Cl. ..... 83/707; 83/468

[58] Field of Search ..... 83/707, 713–731, 83/467, 468, 409, 412, 415

[56] References Cited

U.S. PATENT DOCUMENTS 2,001,771 5/1935 Campbell ..... 83/707

2,691,398 10/1954 Klingens ..... 83/717

FOREIGN PATENT DOCUMENTS 669277 4/1952 United Kingdom ..... 83/717

*Primary Examiner*—James M. Meister

*Attorney, Agent, or Firm*—Leydig, Voit & Mayer, Ltd.

[57] ABSTRACT

The invention relates to a device for setting the thickness of cut in cold meat slicing machines. In order to bring a stop plate on such a machine into parallel alignment with the cutting plane of the machine, provision is made for the stop plate to be rigidly connected to a guide axis aligned and displaceable transversely relative to the stop plate, and for the axis to be axially displaceable in two spherical bearings pivotably supported on the machine frame and to be supported against rotation by a bracket rigidly connected to the axis and slidingly guided in the machine frame, with a mechanism for setting the thickness of cut engaging the bracket, and for one of the spherical bearings to be adjustable in two directions extending substantially radially relative to the guide axis for the purpose of positioning the stop plate and the circular cutter blade parallel to each other.

5 Claims, 6 Drawing Figures

DEVICE FOR SETTING THE THICKNESS OF CUT IN COLD MEAT SLICING MACHINES

The invention relates to a device for setting the thickness of cut in cold meat slicing machines comprising a machine frame, a rotating circular cutter blade mounted for rotation in the machine frame, a carriage reciprocatable on the machine frame for depositing and advancing stock to be sliced, and a stop plate adjustable relative to the circular cutter blade to set the thickness of cut, with a level abutment surface for the stock to be sliced.

Machines of this kind serve, above all, the purpose of slicing foodstuffs, particularly meat, sausage, cheese and the like. As a rule, they comprise a stop plate adjustable relative to the cutting plane of the circular cutter blade, with a level abutment surface for the stock to be sliced, for setting the thickness of the slice to be cut (thickness of cut), with the distance between the cutting plane of the blade and the abutment surface at which the stock to be sliced is slidingly guided along during the slicing operation being adjustable for the setting of the thickness of cut.

The precondition of easy adjustability and uniform slice thickness throughout the entire slice circumference are a precise parallel guidance of the stop plate relative to the circular cutter blade and an exactly parallel positioning of the abutment surface relative to the cutting plane. In known devices, the setting of the parallelism of the abutment and cutting planes proves difficult and is often not perfectly realizable as existing manufacturing tolerances may add up and require compensation by supplementary machining when the slicing machine is assembled.

The object underlying the invention is to improve a device of the aforementioned kind, while retaining a smooth-running, precise guidance of the stop plate relative to the circular cutter blade, so that the precise setting of the parallelism of the abutment and cutting planes is possible in a simple manner.

The object is attained in the form of the following features:

a. the stop plate is rigidly connected to a guide axis substantially transversely displaceable relative to its abutment surface;
b. the guide axis is axially displaceable in two spherical bearings pivotably supported on the machine frame, and is
c. supported against rotation by a bracket rigidly connected to it and slidingly guided on the machine frame;
d. a mechanism engages the bracket to set the thickness of cut;
e. one of the spherical bearings is adjustable in two directions extending substantially radially relative to the guide axis in order to make the stop plate and the circular cutter blade parallel.

A preferred embodiment of the invention will now be more particularly described with reference to the accompanying drawings, in which.

Figure 1:
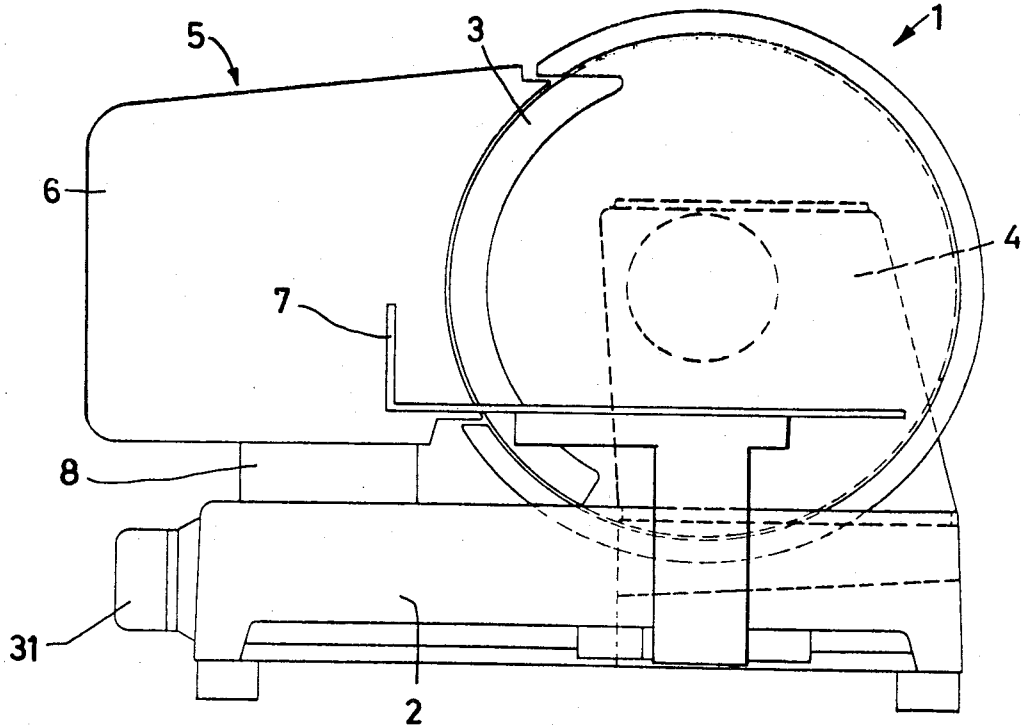
FIG. 1 shows a schematic side view of a cold meat slicing machine.
Figure 2:
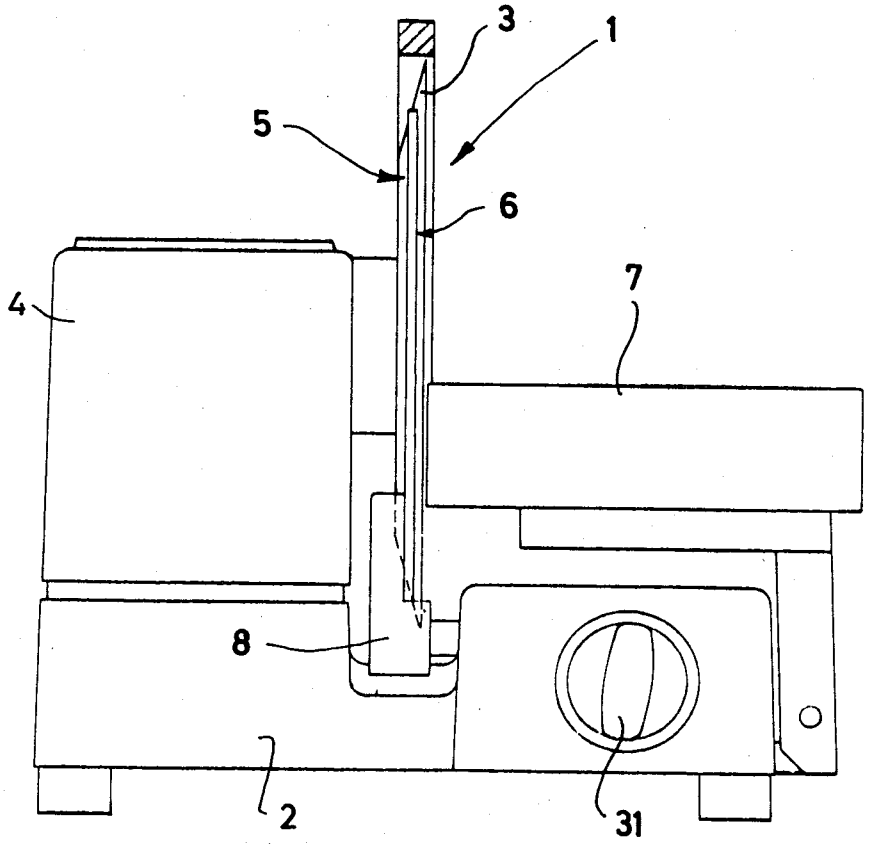
FIG. 2 shows a schematic front view of the machine shown in FIG. 1.

A cold meat slicing machine 1 comprises a machine frame 2, with a circular cutter blade 3 rotatably mounted thereon. The circular cutter blade 3 is made to rotate by a motor, not illustrated, which is enclosed by a housing section 4. A stop plate 5 comprises a level abutment surface 6 extending parallel to the cutting plane of the circular cutter blade 3. The distance of the abutment surface 6 from the cutting plane of the circular cutter blade determines the slice thickness or the thickness of cut setting of the machine. The stock to be sliced is placed on a carriage 7, which is slidably displaceable in a manner known per se parallel to the cutting plane of the circular cutter blade 3 (and perpendicularly to the drawing plane of FIG. 2). The stock to be sliced (not illustrated) is held against the abutment surface 6 of the stop plate 5 and advanced, horizontally on the carriage 7, towards the rotating circular cutter blade 3.

The stop plate 5 is rigidly connected to a guide axis 9 by a supporting flange 8. The guide axis 9 is mounted for axial displacement, on the one hand, by a first spherical bearing 11, on emerging from the machine frame 2, and, on the other hand, by a second spherical bearing 12 inside the housing. These spherical bearings 11, 12 are bearings which slidingly accommodate the guide axis 9 and, in turn, are supported in a universally pivotable manner on the machine frame 2, which may, for example, be enabled by ball-type surfaces of complementary configuration. Aside from being pivotable on the machine frame 2, the spherical bearing 11 is not further adjustable. The spherical bearing 12 is adjustable in two directions X and Y (FIGS. 3 and 4) extending radially relative to the guide axis and standing substantially perpendicularly on one another. When the spherical bearing 12 is adjusted, the guide axis 9 and the other spherical bearing 11 supporting it are pivoted. This, ultimately, enables the setting of the parallelism of the stop plate 5 and the circular cutter blade 3 in a manner which will be subsequently described.

The spherical bearing 12 is mounted in a bearing block 13 secured to the machine frame 2 by two threaded bolts 14, 15 and adjustment nuts 16, 17, and 18, 19, respectively, seated on them. The nuts 16, 18, comprised by knurled nuts, constitute the actual adjusting nuts, while the nuts 17, 19 are counter nuts. The threaded bolts 14, 15 engage elongate apertures 21 and 22, respectively (FIG. 3) arranged laterally on the bearing block 13. The elongate apertures 21, 22 extend in the X direction, the threaded bolts 14, 15 in the Y direction. When the counter nuts 17, 19 are slackened, the bearing block 13, together with the spherical bearing 12 pivotably supported by it, is displaceable in the X direction. The bearing block 13 is displaceable in the Y direction by adjustment of the knurled nuts 16, 18. The threaded bolts 14, 15 are seated in a substantially vertically fixed manner in the machine frame 2.

Accordingly, displacement of the bearing block 13 in the X and/or Y direction results in angular motion of the guide axis 9 and, consequently, of the stop plate 5, about the center point of the spherical bearing 11, so that, within a certain range, each deviation in parallelism between the cutting plane of the circular cutter blade 3 and the abutment surface 6 of the stop plate 5 may be compensated. The guide axis 9 is prevented from canting in the receiving bores of the spherical bearings 11 and 12 by the pivotability of the spherical bearing 12 in the bearing block 13.

Figure 4:
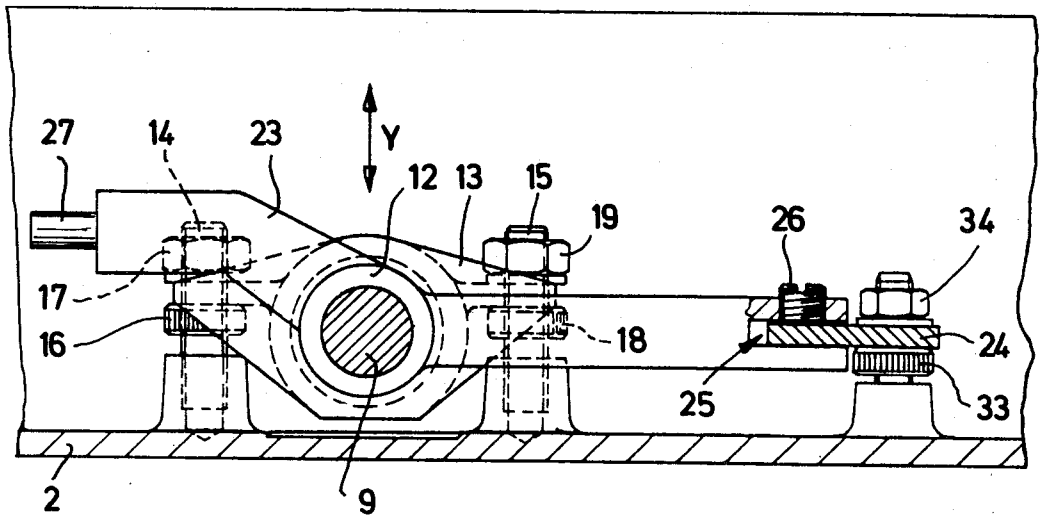
FIG. 4 shows a partial sectional view, taken along line 4—4 in FIG. 3.
Figure 5:
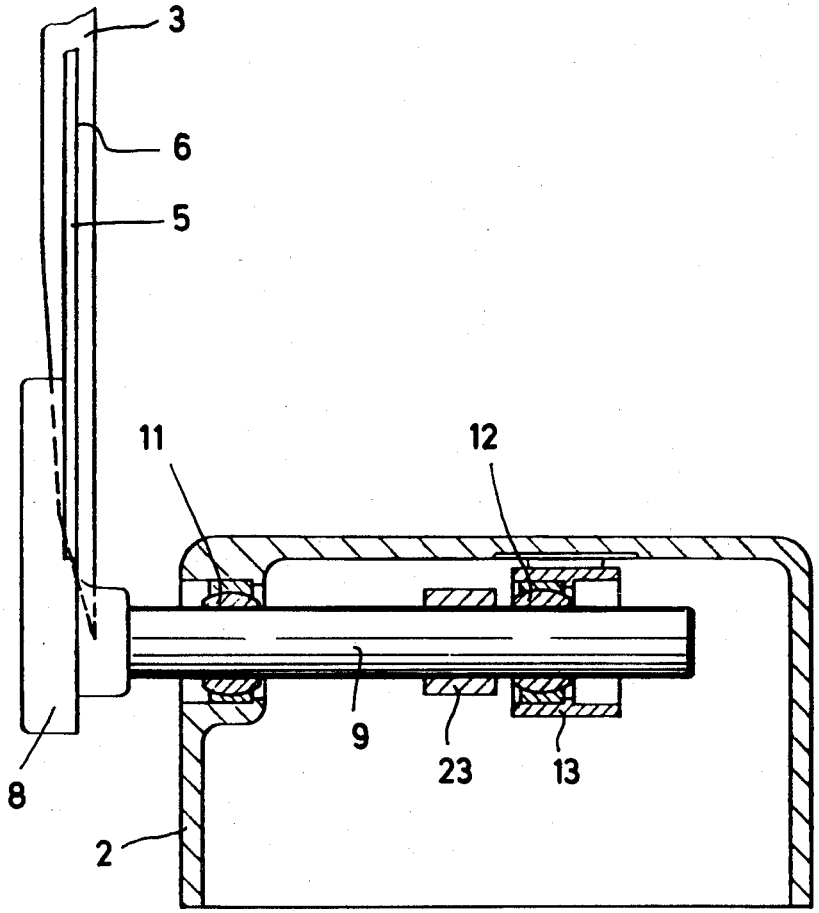
FIG. 5 shows a partial sectional view, taken along line 5—5 in FIG. 3.
Figure 6:
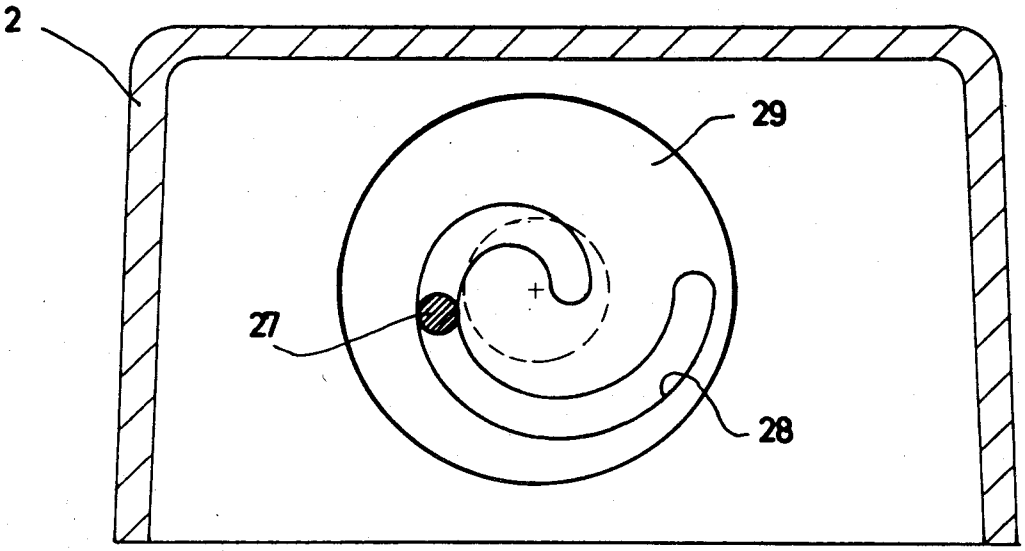
FIG. 6 shows a view of a mechanism for setting the thickness of cut in the direction of arrow N in FIG. 3.

The thickness of cut, i.e., the adjustment of the distance between the circular cutter blade 3 and the stop plate 5, is set by displacement of the guide axis 9 rigidly connected to the stop plate 5 in its longitudinal direction within the spherical bearings 11, 12. A bracket 23 rigidly connected to the guide axis 9 between the two spherical bearings 11, 12 supports the guide axis 9 against rotation on a bar 24 stationarily mounted on the frame (FIG. 4). The end of the bracket 23 facing the bar 24 is in the form of a fork 25 and encloses the free edge of the bar 24 from the top and the bottom. This end of the bracket is slidably guided on the bar 24. A set screw 26 is provided for slidable guide adjustment free of play.

To adjust the bracket 23 and, therefore, the guide axis 9 rigidly connected to it, and, consequently, in turn, the stop plate 5 rigidly attached to it, in the longitudinal direction of the guide axis 9, the end of the bracket 23 remote from the bar 24 comprises an entrainment pin 27 which engages a helical groove 28 in a disc 29. The disc 29 is mounted for rotation at a wall of the machine frame 2 and for rotation together with a handle 31 on the outside of the machine frame 2. When the handle 31 and the disc 29 are turned, the helcial groove 28, which then also turns, displaces the entrainment pin 27, and, ultimately, the stop plate 5 parallel to the cutting plane of the circular cutter blade 3, with the sliding guidance being provided by the guide axis 9 guided in the spherical bearings 11, 12 and the fork 25 of the bracket 23.

On the one hand, the bar 24 is pivotably supported at 32 (FIG. 3), and, on the other hand, adjustable and fixable (FIG. 4) by a knurled nut 33 and a counter nut 34. When the bearing block 13 is displaced in the Y direction, the alignment of the bar 24 is reset by the nuts 33, 34. A displacement of the bearing block 13 in the X direction is compensated by the fork 25.

Figure 3:
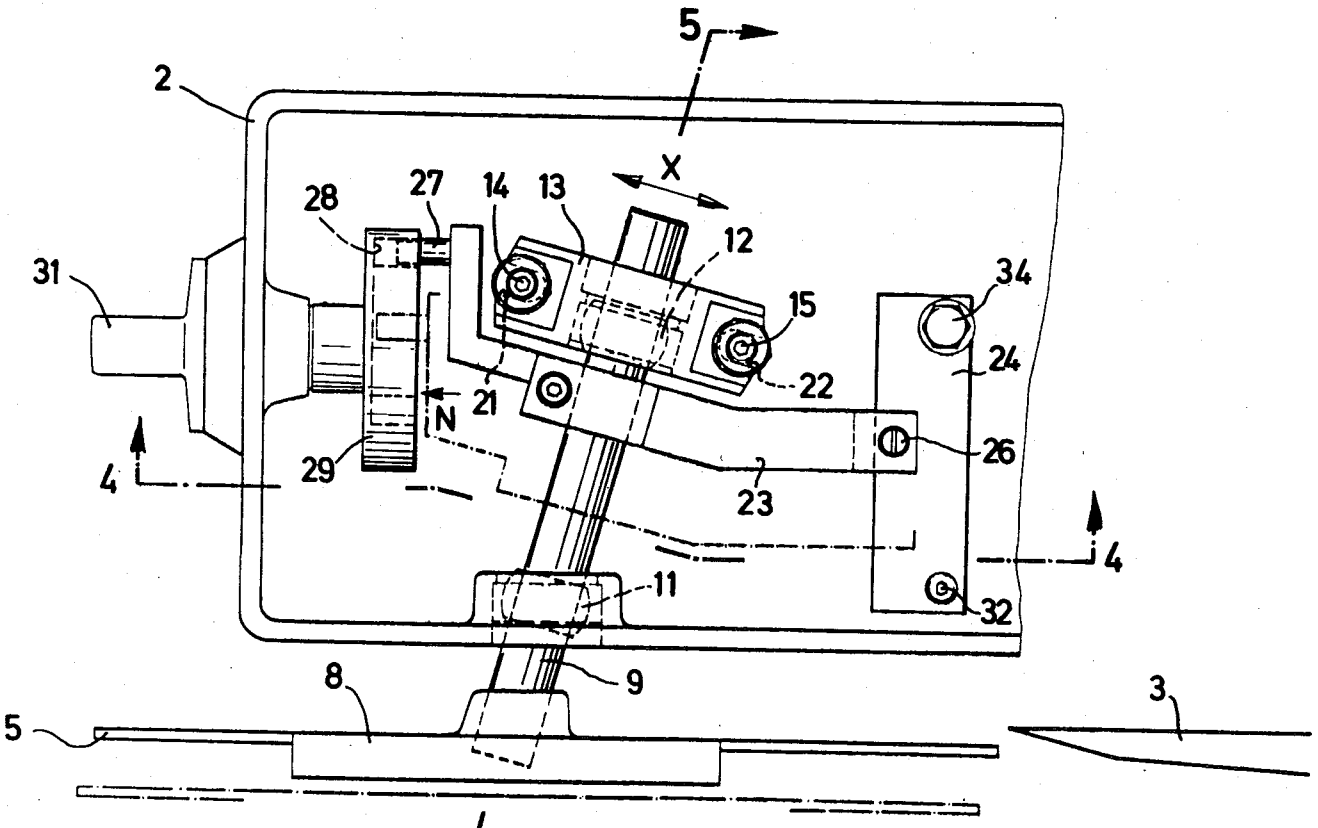
FIG. 3 shows a schematic, partially truncated, bottom view of the machine.

FIG. 3 shows a first setting of the stop plate 5 in unbroken, and a second setting of this plate in dot-and-dash lines.

The arrangement described hereinabove may find employment in both cold meat slicing machines with vertically positioned and such with obliquely disposed circular cutter blades.

We claim:

1. Device for setting the thickness of cut in cold meat slicing machines comprising a machine frame, a rotating circular cutter blade mounted for rotation in the machine frame, a carriage reciprocatable on the machine frame for depositing and advancing stock to be sliced, and a stop plate adjustable relative to the circular cutter blade to set the thickness of cut, with a level abutment surface for the stock to be sliced, characterized by the following features:

a. the stop plate (5) is rigidly connected to a guide axis (9) substantially transversely displaceable relative to its abutment surface (6);

b. the guide axis (9) is axially displaceable in two spherical bearings (11, 12) pivotably supported on the machine frame (2), and is c. supported against rotation by a bracket (23) rigidly connected to the guide axis (9) and slidingly guided on the machine frame;

d. a mechanism (28, 29, 31) engages the bracket (23) to set the thickness of cut;

e. one of the spherical bearings (12) is adjustable in two directions (X, Y) extending substantially radially relative to the guide axis (9) in order to make the stop plate (5) and the circular cutter blade (3) parallel.

2. Device according to claim 1, characterized in that the adjustable spherical bearing (12) is built into a bearing block (13) guided in the one direction (X) in elongate apertures (21, 22) on two threaded bolts (14, 15) and adjustable in the other direction (Y) by adjustment nuts (16, 17, 18, 19) seated on this bolt.

3. Device according to claims 1 or 2, characterized in that the bracket (23) is slidingly supported by a fork (25) on a bar (24) adjustable in the radial direction (Y).

4. Device according to claims 1 or 2, characterized in that the mechanism for setting the thickness of cut includes a turning handle (31) and a disc (29) connected for rotation with it and having a helical groove (28) engaged by an entrainment pin (27) on the bracket (23).

5. Device according to claim 3, characterized in that the mechanism for setting the thickness of cut includes a turning handle (31) and a disc (29) connected for rotation with it and having a helical groove (28) engaged by an entrainment pin (27) on the bracket (23).

* * * * *